US009395089B2

(12) United States Patent
Nelson et al.

(10) Patent No.: US 9,395,089 B2
(45) Date of Patent: Jul. 19, 2016

(54) OVEN APPLIANCE AND A HINGE ASSEMBLY FOR THE SAME

(71) Applicant: General Electric Company, Schenectady, NY (US)

(72) Inventors: Nathan Ernell Nelson, Louisville, KY (US); John Adam Yantis, Prospect, KY (US); Scott Thomas Kershner, La Grange, KY (US); Darren Allen Turner, Louisville, KY (US); Srisurya Prakash Pilli, Hyderabad (IN)

(73) Assignee: General Electric Company, Schenectady, NY (US)

( * ) Notice: Subject to any disclaimer, the term of this patent is extended or adjusted under 35 U.S.C. 154(b) by 385 days.

(21) Appl. No.: 14/078,811

(22) Filed: Nov. 13, 2013

(65) Prior Publication Data

US 2015/0128927 A1 May 14, 2015

(51) Int. Cl.

| | |
|---|---|
| ***F24C 15/02*** | (2006.01) |
| ***E05D 7/04*** | (2006.01) |
| ***E05D 7/00*** | (2006.01) |

(52) U.S. Cl.

CPC ..... *F24C 15/023* (2013.01); *E05D 7/0045* (2013.01); *E05D 7/043* (2013.01); *E05D 2007/0072* (2013.01); *E05D 2007/0446* (2013.01); *E05D 2007/0469* (2013.01); *E05Y 2900/308* (2013.01)

(58) Field of Classification Search

CPC ..... E05D 7/04
USPC ..... 126/194, 340
See application file for complete search history.

(56) References Cited

U.S. PATENT DOCUMENTS

| | | | | |
|---|---|---|---|---|
| 3,091,232 | A | 5/1963 | Allen, Jr. | |
| 4,892,085 | A * | 1/1990 | Salvi | F24C 15/162 126/340 |
| 2008/0034539 | A1 | 2/2008 | Lyvers et al. | |
| 2011/0148262 | A1* | 6/2011 | Basavalingappa Mudbasal | E05F 1/1261 312/319.2 |
| 2012/0025686 | A1* | 2/2012 | Darney | E05D 3/18 312/405 |

FOREIGN PATENT DOCUMENTS

| | | |
|---|---|---|
| EP | 1995523 | 11/2008 |
| GB | 495325 | 11/1938 |

* cited by examiner

*Primary Examiner* — Avinash Savani
(74) *Attorney, Agent, or Firm* — Dority & Manning, P.A.

(57) ABSTRACT

An oven appliance is provided. The oven appliance includes a door and a hinge assembly for rotatably mounting the door to a cabinet. The hinge assembly includes features for adjusting a position of the door. At least one of a vertical position and a lateral position of the door can be adjusted with the hinge assembly.

16 Claims, 7 Drawing Sheets

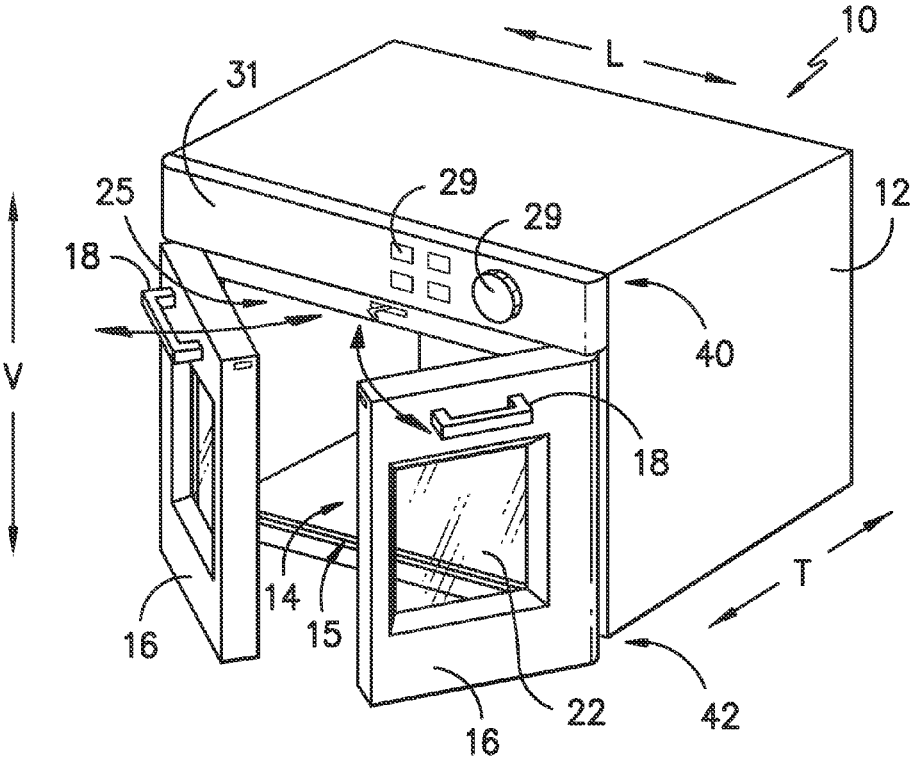
FIG. —1—
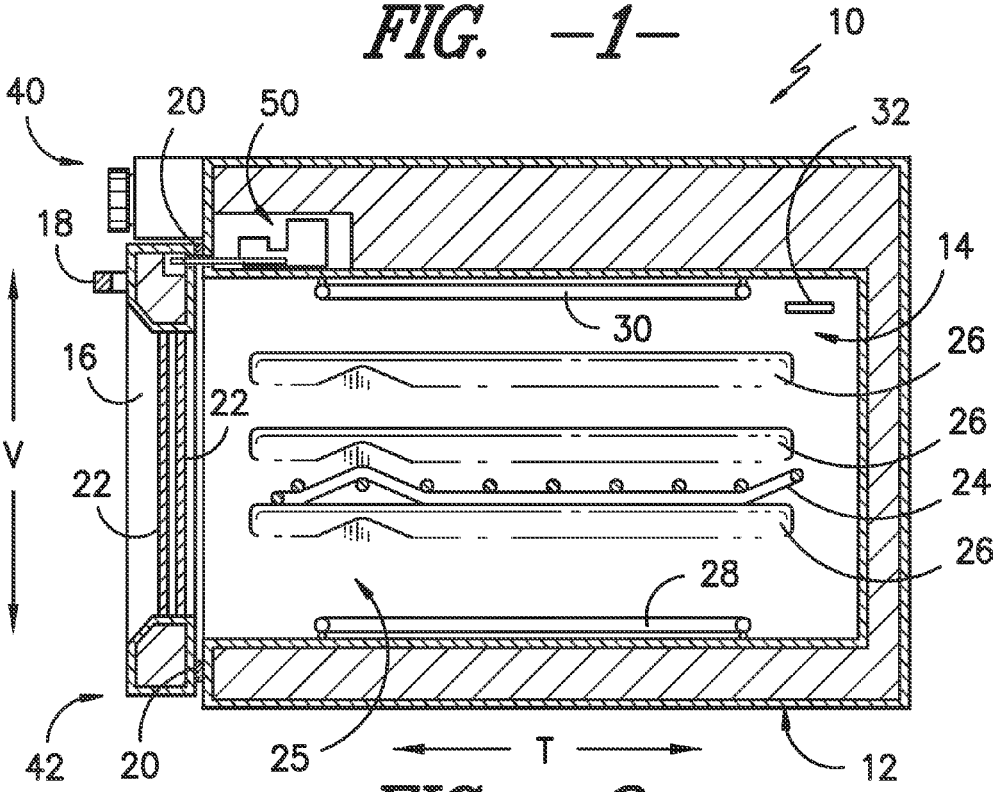
FIG. —2—

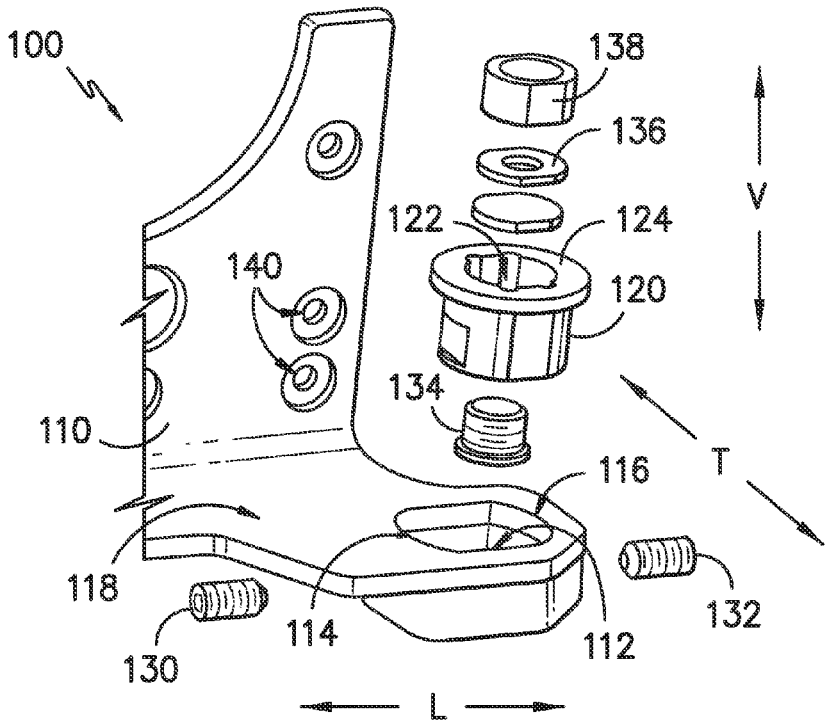
FIG. —4—
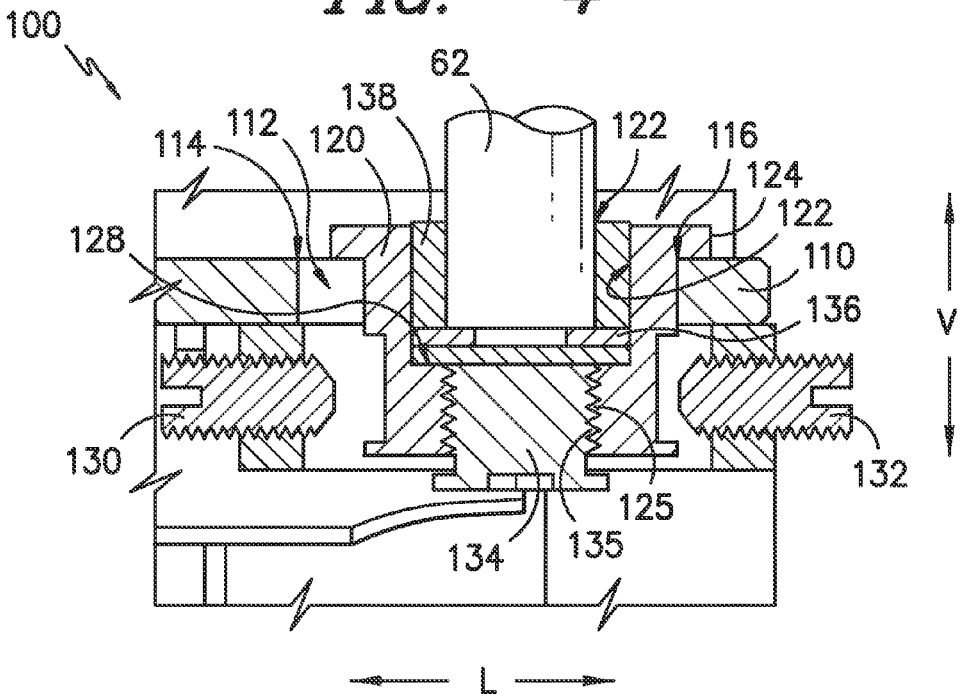
FIG. —5—

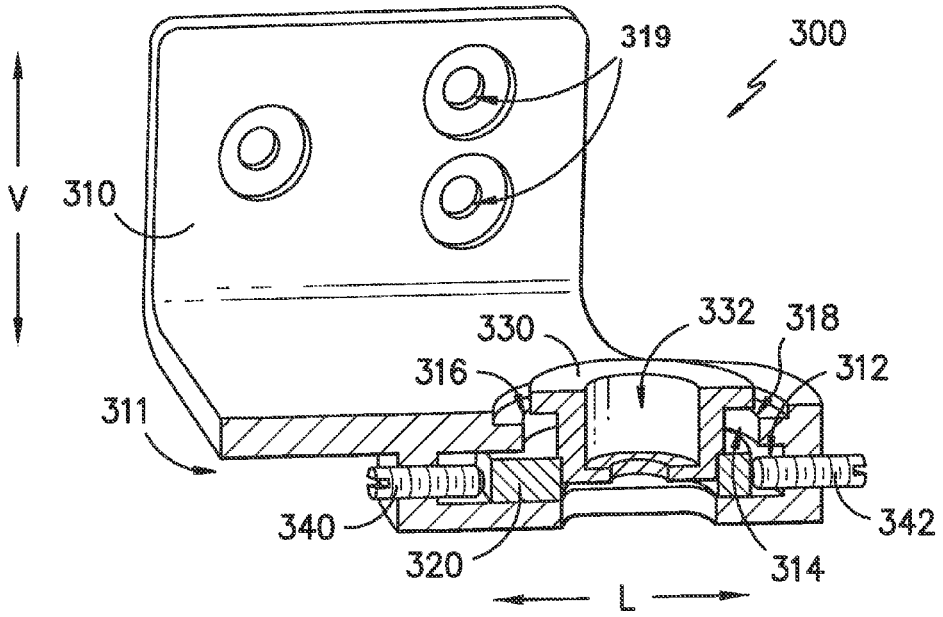
FIG. —7—
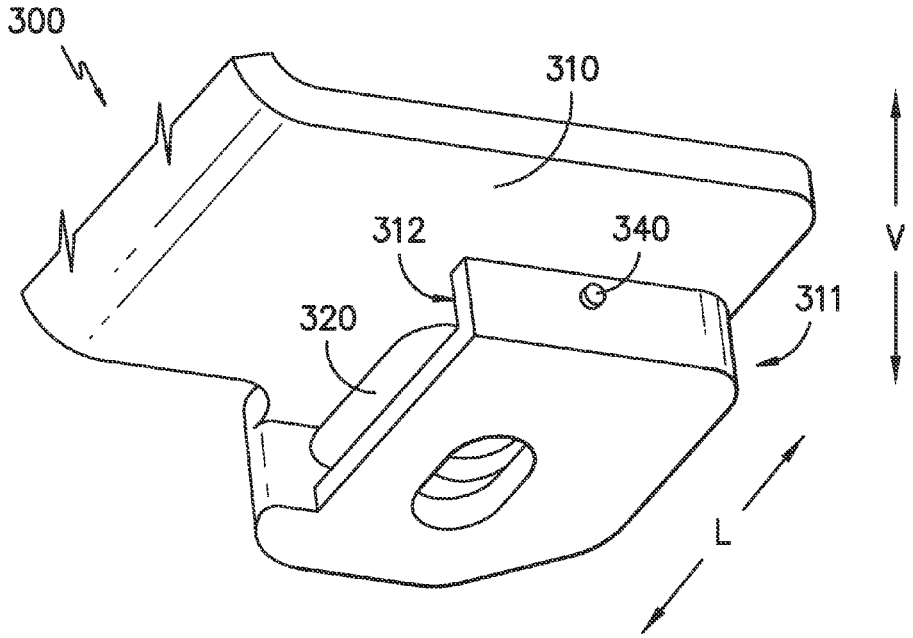
FIG. —8—

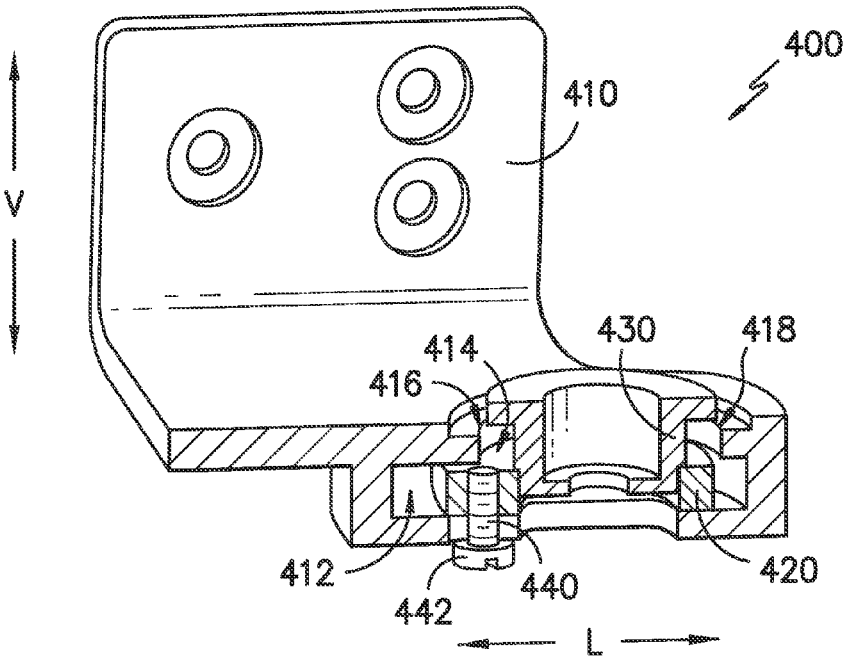
FIG. —9—
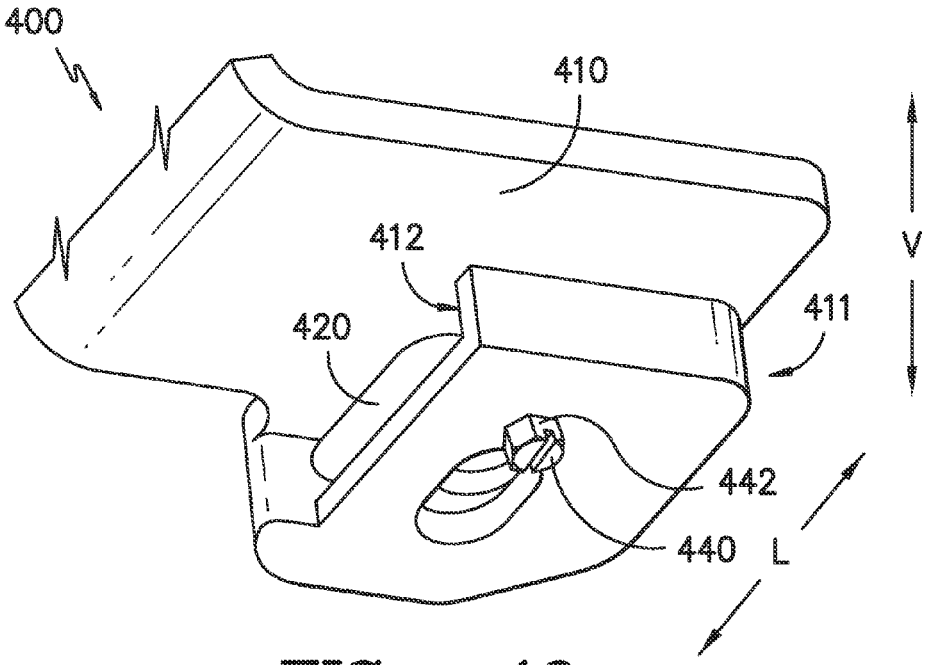
FIG. —10—

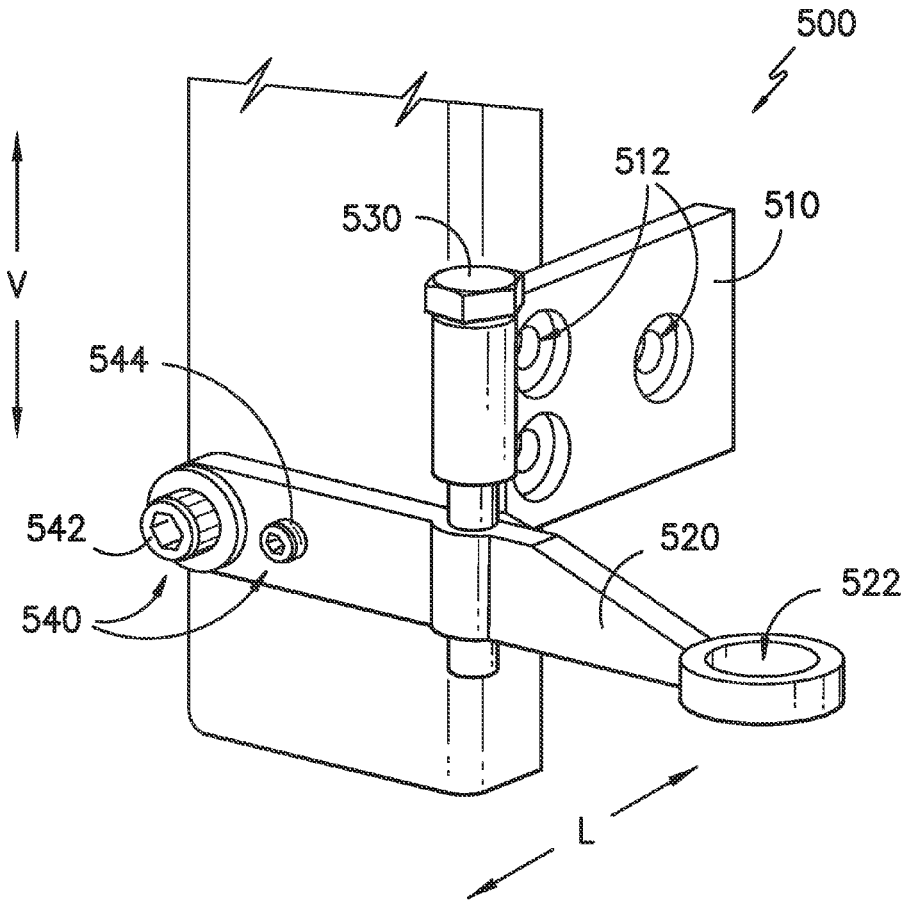
FIG. —11—

OVEN APPLIANCE AND A HINGE ASSEMBLY FOR THE SAME

FIELD OF THE INVENTION

The present subject matter relates generally to oven appliances, such as French door style oven appliances, and hinge assemblies for oven appliances.

BACKGROUND OF THE INVENTION

Oven appliances generally include a cabinet that defines a cooking chamber for receipt of food articles for cooking. The cabinet can also define an opening for accessing the cooking chamber. Certain oven appliances include a pair of doors rotatably mounted to the cabinet at the opening to permit selective access to the cooking chamber through the opening. Oven appliances having such doors are generally referred to as French door style oven appliances.

The doors define a gap therebetween in a closed position. Generally, consumers prefer the gap to have a uniform shape. Similarly, consumers also prefer corners of the doors to align when the doors are in the closed position. However, the position of the doors relative to each other affects the gap's appearance and the alignment of the doors' corners. Adjusting the position of the doors relative to each other can be difficult. Further, the position of the doors can be set during manufacture of the oven appliance, and the position can change during transit of the oven appliance from its place of manufacture.

Accordingly, an oven appliance with features for adjusting a position of doors of the oven appliance would be useful. In particular, an oven appliance with features for adjusting a vertical and/or lateral position of doors of the oven appliance would be useful.

BRIEF DESCRIPTION OF THE INVENTION

The present subject matter provides an oven appliance. The oven appliance includes a door and a hinge assembly for rotatably mounting the door to a cabinet. The hinge assembly includes features for adjusting a position of the door. At least one of a vertical position and a lateral position of the door can be adjusted with the hinge assembly. Additional aspects and advantages of the invention will be set forth in part in the following description, or may be apparent from the description, or may be learned through practice of the invention.

In a first exemplary embodiment, an oven appliance is provided. The oven appliance defines a vertical direction and a lateral direction. The vertical and lateral directions are perpendicular to each other. The oven appliance includes a cabinet that defines a cooking chamber and a door having an axle. A hinge assembly rotatably mounts the door to the cabinet. The hinge assembly includes a bracket mounted to the cabinet. The bracket defines a slot that extends along the lateral direction between a first end portion and a second end portion. An insert is received within the slot such that the insert is movable between the first end portion of the slot and the second end portion of the slot. The insert defines an inner chamber. The axle of the door is received within the inner chamber of the insert.

In a second exemplary embodiment, an oven appliance is provided. The oven appliance defines a vertical direction and a lateral direction. The vertical and lateral directions are perpendicular to each other. The oven appliance includes a cabinet that defines a cooking chamber and a door having an axle. A hinge assembly rotatably mounts the door to the cabinet.

The hinge assembly includes a bracket mounted to the cabinet. The bracket defines a pocket and a slot. The slot extends along the lateral direction between a first end portion and a second end portion. A mover is disposed within the pocket of the bracket. An insert is rotatably mounted to the mover such that a thread of the insert engages a thread of the mover. The insert is received within the slot such that the insert is movable between the first end portion of the slot and the second end portion of the slot. The insert defines an inner chamber. The axle of the door is received within the inner chamber of the insert. A position of the axle along the vertical direction is selectively adjustable by rotating the insert relative to the mover.

In a third exemplary embodiment, an oven appliance is provided. The oven appliance defines a vertical direction and a lateral direction. The vertical and lateral directions are perpendicular to each other. The oven appliance includes a cabinet that defines a cooking chamber and a door having an axle. A hinge assembly rotatably mounts the door to the cabinet. The hinge assembly includes a bracket mounted to the cabinet and a pivot arm mounted to the cabinet. The pivot arm is positioned below the bracket along the vertical direction. The pivot arm defines an opening. The axle of the door is received within the opening of the pivot arm. A bolt extends between the bracket and the pivot arm. A thread of the bolt engages a thread of the pivot arm such that the bolt couples the bracket and the pivot arm. A position of the axle along the vertical direction is selectively adjustable by rotating the bolt relative to the bracket and the pivot arm.

In a fourth exemplary embodiment, an oven appliance is provided. The oven appliance defines a vertical direction and a lateral direction. The vertical and lateral directions are perpendicular to each other. The oven appliance includes a cabinet that defines a cooking chamber and a door having an axle. A hinge assembly rotatably mounts the door to the cabinet. The hinge assembly includes a bracket mounted to the cabinet. An insert has a thread that engages a thread of the bracket such that the insert is rotatably mounted to the bracket. The insert defines an inner chamber. The axle of the door is received within the inner chamber of the insert. A position of the axle along the vertical direction is selectively adjustable by rotating the insert relative to the bracket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 1 provides a front, perspective view of an oven appliance according to an exemplary embodiment of the present subject matter.

FIG. 2 provides a side, section view of the exemplary oven appliance of FIG. 1.

FIG. 4 provides an exploded view of a hinge assembly for a door according to an exemplary embodiment of the present subject matter.

FIG. 5 provides a partial, section view of the exemplary hinge assembly of FIG. 4.

FIG. 7 provides a perspective, section view of a hinge assembly for a door according to an additional exemplary embodiment of the present subject matter.

FIG. 8 provides a bottom partial, perspective view the exemplary hinge assembly of FIG. 7.

FIG. 9 provides a perspective, section view of a hinge assembly for a door according to a further exemplary embodiment of the present subject matter.

FIG. 10 provides a bottom partial, perspective view the exemplary hinge assembly of FIG. 9.

FIG. 11 provides a perspective, section view of a hinge assembly for a door according to yet another exemplary embodiment of the present subject matter.

DETAILED DESCRIPTION

Figure 3:
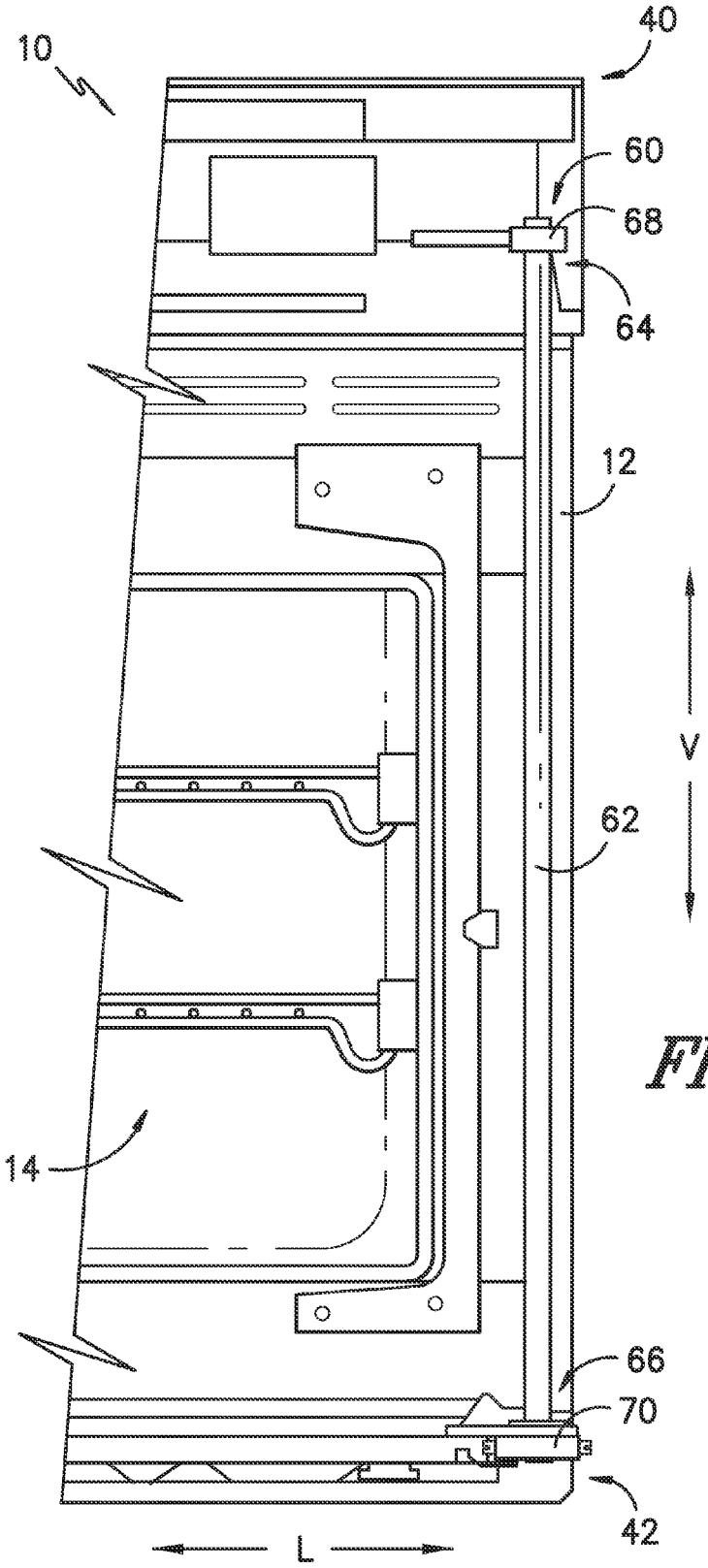
FIG. 3 provides a partial, front elevation view of the exemplary oven appliance of FIG. 1.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIGS. 1 and 2 illustrate an oven appliance 10 according to an exemplary embodiment of the present subject matter. Oven appliance 10 includes an insulated cabinet 12 with an interior surface 25 that defines a cooking chamber 14. Cooking chamber 14 is configured for the receipt of one or more food items to be cooked.

Cabinet 12 extends between a top portion 40 and a bottom portion 42 along a vertical direction V. Cabinet 12 also defines a lateral direction L and a transverse direction T. The vertical, lateral, and transverse directions V, L, and T are mutually perpendicular and form an orthogonal direction system.

Oven appliance 10 also includes a pair of doors 16 rotatably mounted on cabinet 12 proximate an opening 15 to chamber 14 defined by cabinet 12. Thus, oven appliance 10 is sometimes referred to as a French door style oven appliance. Doors 16 are configured for selectively shifting between an open position or configuration shown in FIG. 1 in which a user can access cooking chamber 14 and a closed position or configuration shown in FIG. 2 in which the user is impeded from accessing cooking chamber 14 by doors 16. Handles 18 are attached to doors 16 and assist with shifting doors 16 between the open and closed positions.

One or more gaskets 20 between doors 16 and cabinet 12 provide for maintaining heat and cooking fumes within chamber 14 when doors 16 are in the closed position as shown in FIG. 2. Glass panes 22 provide for viewing the contents of chamber 14 when doors 16 are in the closed position as well as providing insulation between chamber 14 and the exterior of oven appliance 10. A rack 24 is positioned in chamber 14 for the receipt of food items. Rack 24 is slidably received onto ribs/rails 26 such that rack 24 may be conveniently moved into and out of chamber 14 when doors 16 are open. Multiple rails 26 are provided so that the height of rack 24 may be adjusted.

Heating elements 28 and 30 are positioned within chamber 14 of cabinet 12. Heating elements 28 and 30 are used to heat chamber 14 for both cooking and cleaning of oven appliance 10. While electrically-resistive heating elements 28 and 30 are shown, the present subject matter may be used with other heating elements as well such as gas burners or microwave elements.

The operation of oven appliance 10 including heating elements 28 and 30 is controlled by one or more processing devices (not shown) such as a microprocessor other device that is in communication with such components. User manipulated controls 29 on control panel 31 allow the user to make selections regarding temperature, time, and other options. The selections can be communicated to the processing device for operation of oven appliance 10. Such processing device is also in communication with a temperature sensor 32 that is used to measure temperature inside chamber 14. Although only one temperature sensor 32 is shown, it should be understood that multiple sensors can be placed within oven appliance 10 for determining the oven temperature.

Oven appliance 10 is provided by way of example only. Thus, the present subject matter may be used in any other suitable oven appliance configuration. For example, the present subject matter may be used in oven range appliances or in oven appliances that define multiple interior cavities for the receipt of food and/or have different pan or rack arrangements than the exemplary embodiment shown in FIG. 2. Heating elements at the top, back, or sides of chamber 14 may also be provided, and a variety of different types of heating elements such as microwave, halogen, gas fuel, electrical resistance, and combinations thereof may be used. Other configurations may also be used as will be understood by one of skill in the art using the teachings disclosed herein.

As may be seen in FIG. 2, oven appliance 10 includes a lock assembly 50. Lock assembly 50 is configured for selectively securing doors 16 in the closed position. For example, during a cleaning cycle of oven appliance 10, cooking chamber 14 and heating elements 28, 30 can reach high temperatures. Lock assembly 50 can secure doors 16 in the closed position during the cleaning cycle, e.g., in order to prevent the user from opening doors 16 and accessing cooking chamber 14.

FIG. 3 provides a partial, front elevation view of oven appliance 10. As may be seen in FIG. 3, oven appliance 10 includes a hinge assembly 60 for rotatably mounting one of doors 16 to cabinet 12. A similar hinge assembly can be used to mount to other of doors 16 to cabinet 12.

Hinge assembly 60 includes a post or axle 62. Axle 62 extends between a first end portion 64 and a second end portion 66, e.g., along the vertical direction V. Hinge assembly 60 also includes an upper hinge 68 and a lower hinge 70. Upper hinge 68 is mounted to cabinet 12, e.g., at or adjacent top portion 40 of cabinet 12 such that upper hinge 68 is positioned above chamber 14 of cabinet 12 along the vertical direction V. Conversely, lower hinge 70 is mounted to cabinet 12, e.g., at or adjacent bottom portion 42 of cabinet 12 such that lower hinge 70 is positioned below chamber 14 of cabinet 12 along the vertical direction V.

Axle 62 is fixed to one of door 16 such that axle 62 rotates with the one of doors 16. In addition, axle 62 is rotatably mounted to upper hinge 68 and lower hinge 70 in order to rotatably mount the one of doors 16 to cabinet 12. In particular, first end portion 64 of axle 62 is positioned at or adjacent upper hinge 68, e.g., such that axle 62 is rotatably mounted to upper hinge 68 at first end portion 64 of axle 62. Conversely, second end portion 66 of axle 62 is positioned at or adjacent lower hinge 70, e.g., such that axle 62 is rotatably mounted to lower hinge 70 at second end portion 66 of axle 62.

Turning back to FIG. 1, doors 16 define a gap therebetween, e.g., when doors 16 are in the closed position. The gap between doors 16 can vary, e.g., along the vertical direction V, depending upon the position of doors 16 relative to each other. Hinge assembly 60 includes features for assisting with adjusting a position of doors 16, e.g., along the vertical direction V or lateral direction L to assist with making the gap between doors 16 uniform or consistent. Such features can also assist with aligning corners of doors 16 along the vertical direction V.

FIG. 4 provides an exploded view of a hinge assembly 100 for a door according to an exemplary embodiment of the present subject matter. FIG. 5 provides a partial, section view of hinge assembly 100. Hinge assembly 100 can be used with any suitable door, e.g., to mount the door to a cabinet. As an example, hinge assembly 100 may be used in oven appliance 10 (FIG. 1) to mount one of doors 16 to cabinet 12. In particular, hinge assembly 100 may be used as lower hinge 70 in oven appliance 100.

Hinge assembly 100 includes a bracket 110. Bracket 110 can be mounted to cabinet 12, e.g., at bottom portion 42 of cabinet 12. Bracket 110 can be mounted to cabinet 12 using any suitable method or mechanism. For example, fasteners may extend through holes 140 defined by bracket 110 into cabinet 12 in order to mount or fix bracket 110 to cabinet 12. As another example, bracket 110 may be welded, glued, snap-fit, etc. to cabinet 12. Bracket 110 can be constructed of or with any suitable material. For example, bracket 110 may be constructed from or with a metal, such as steel or aluminum.

Bracket 110 defines a slot 112. Slot 112 extends, e.g., along the lateral direction L, between a first end portion 114 and a second end portion 116. Thus, first and second end portions 114 and 116 of slot 112 are spaced apart from each other, e.g., along the lateral direction L.

Hinge assembly 100 also includes an insert 120. Insert 120 is received or disposed within slot 112. In particular, insert 120 can move or slide within slot 112, e.g., between first end portion 114 and second end portion 116 of slot 112. Movement of insert 120 can assist with positioning of door 16, e.g., along the lateral direction L, as discussed in greater detail below. Insert 120 can be constructed of or with any suitable material. For example, insert 120 may be constructed from or with a metal, such as steel or aluminum, or a plastic.

Insert 120 includes a flange 124. Flange 124 has a width, e.g., along the transverse direction T, that is greater than a width of slot 112, e.g., along the transverse direction T. Thus, flange 124 can be positioned or disposed on a top surface 118 of bracket 110. Flange 124 can support insert 120 on bracket 110 and hinder or prevent downward movement of insert 120, e.g., along the vertical direction V, relative to bracket 110. Flange 124 can slide on top surface 118 of bracket 110 during motion of insert 120 within slot 112.

Insert 120 also defines an inner chamber 122. As may be seen in FIG. 4, axle 62 may be positioned or received within inner chamber 122 of insert 120. Axle 62 is rotatable within chamber 122, e.g., relative to insert 120. In such a manner, axle 62 may be rotatably mounted to hinge assembly 100.

Hinge assembly 100 also includes a height adjustment screw 134. Height adjustment screw 134 is rotatably mounted to insert 120, e.g., such that a thread 125 of insert 120 engages or meshes with a thread 135 of height adjustment screw 134. Thus, height adjustment screw 134 is rotatable relative to insert 120. Height adjustment screw 134 is disposed or positioned below axle 62 such that rotation of height adjustment screw 134 relative to insert 120 adjusts a height of axle 62, e.g., along the vertical direction V. For example, rotation of height adjustment screw 134 relative to insert 120 in a first direction can raise insert 120 and axle 62 along the vertical direction V. Conversely, rotation of height adjustment screw 134 relative to insert 120 in a second, opposite direction can lower insert 120 and axle 62 along the vertical direction V. In such a manner, a position of one of doors 16 along the vertical direction V can be adjusted or changed.

Hinge assembly 100 also includes a thrust bushing 136 and a radial bushing 138. Thrust bushing 136 is disposed or positioned within inner chamber 122 of insert 120. In particular, thrust bushing 136 may be positioned between axle 62 and a bottom surface 128 of insert 120, e.g., inner chamber 122 of insert 120, and/or between axle 62 and height adjustment screw 134 along the vertical direction V. Thrust bushing 136 can assist with limiting or preventing rotation of insert 120 and/or height adjustment screw 134 by axle 62 due to rotation of axle 62 within inner chamber 122 of insert 120. Radial bushing 138 is disposed or positioned within inner chamber 122 of insert 120. In particular, radial bushing 138 may be positioned between axle 62 and a side or inner surface 126 of insert 120, e.g., inner chamber 122 of insert 120, along the lateral direction L and/or transverse direction T. Radial bushing 138 can assist with limiting or preventing rotation of insert 120 by axle 62 due to rotation of axle 62 within inner chamber 122 of insert 120. Thrust bushing 136 and radial bushing 138 can be constructed of or with any suitable material. For example, thrust bushing 136 and radial bushing 138 may be constructed from or with a plastic, bronze, a bronze alloy, etc.

Hinge assembly 100 also includes a first set screw 130 and a second set screw 132. First and second set screws 130 and 132 are rotatably mounted (e.g., threaded) to bracket 110. First and second set screws 130 and 132 are positioned on opposite lateral sides of bracket 110 such that first and second set screws 130 and 132 are spaced apart from each other along the lateral direction L on bracket 110. In particular, first set screw 130 is positioned at or adjacent first end portion 114 of slot 112. Conversely, second set screw 132 is positioned at or adjacent second end portion 116 of slot 112. Insert 120 is positioned or disposed between first and second set screws 130 and 132 in slot 112. First and second set screws 130 and 132 selectively engage insert 120 such that first and second set screws 130 and 132 hinder motion of insert 120 within slot 112 along the lateral direction L. In particular, first and second screws 130 and 132 can be tightened against insert 120 such that insert 120 extends between first and second screws 130 and 132 along the lateral direction L.

Utilizing first and second set screws 130 and 132, a position of insert 120 within slot 112 can be adjusted or changed. For example, as discussed above, insert 120 is moveable within slot 112 between first and second end portions 114 and 116 of slot 112. A user can select the position of insert 120 within slot 112 and tighten first and second set screws 130 and 132 against insert 120 in order to lock or set the position of insert 120 in slot 112. Because axle 62 is disposed in inner chamber 122 of insert 120, a position of one of doors 16 along the lateral direction L can be adjusted or changed by moving insert 120 within slot 112 and utilizing first and second set screws 130 and 132.

Figure 6:
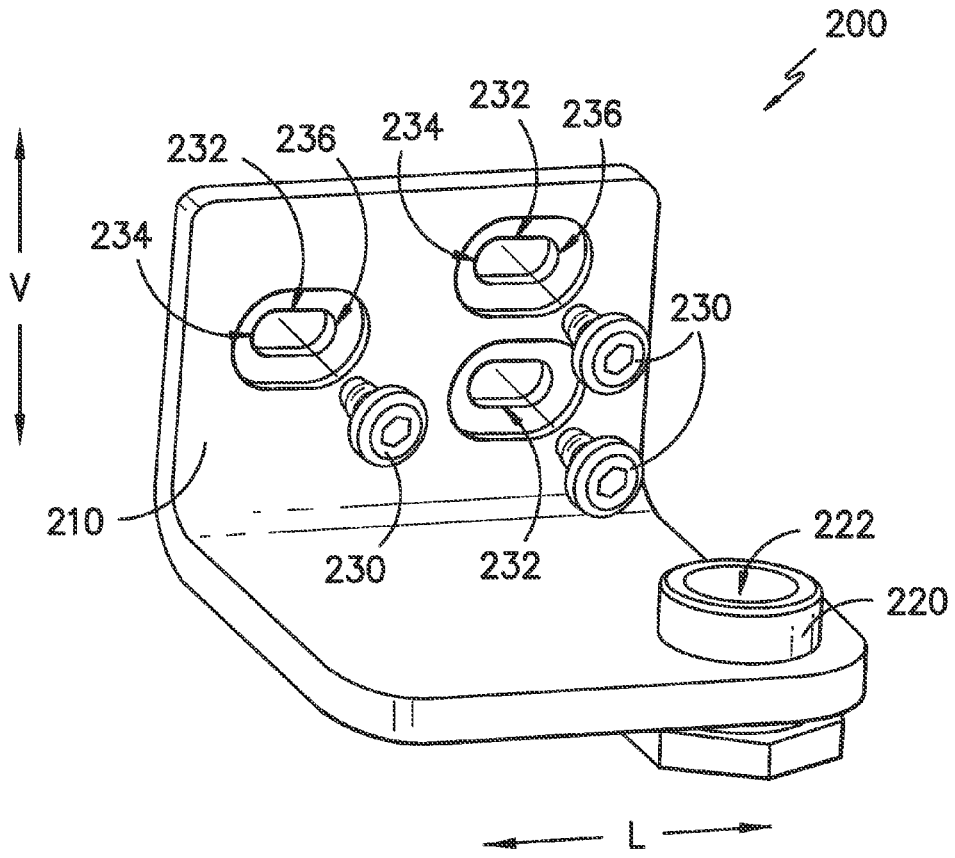
FIG. 6 provides a perspective view of a hinge assembly for a door according to another exemplary embodiment of the present subject matter.

FIG. 6 provides a perspective view of a hinge assembly 200 for a door according to another exemplary embodiment of the present subject matter. Hinge assembly 200 can be used with any suitable door, e.g., to mount the door to a cabinet. As an example, hinge assembly 200 may be used in oven appliance 10 (FIG. 1) to mount one of doors 16 to cabinet 12. In particular, hinge assembly 200 may be used as lower hinge 70 in oven appliance 200.

Hinge assembly 200 includes a bracket 210. Bracket 210 can be mounted to cabinet 12, e.g., at bottom portion 42 of cabinet 12. Hinge assembly 200 includes a plurality of fasteners 230, such as screws, bolts, etc., for mounting bracket 210 to cabinet 12. For example, bracket 210 defines a plurality of slots or holes 232, and each fastener of fasteners 230 can extend through a respective one of holes 232 into cabinet 12 in order to mount bracket 210 to cabinet 12.

Hinge assembly 200 also includes an insert 220. Insert 220 is rotatably mounted or threaded to bracket 210. For example, a thread of insert 220 can engage or mesh with a thread of bracket 210 in order to rotatably mount insert 220 to bracket 210. Insert 220 also defines an inner chamber 222. Axle 62 may be positioned or received within inner chamber 222 of insert 220. Axle 62 is rotatable within chamber 222, e.g., relative to insert 220 and/or bracket 210. In such a manner, axle 62 may be rotatably mounted to hinge assembly 200.

As discussed above, insert 220 is rotatable relative to bracket 210. Rotation of insert 220 relative to bracket 210 adjusts a height of axle 62, e.g., along the vertical direction V. For example, rotation of insert 220 relative to bracket 210 in a first direction can raise insert 220 and axle 62 along the vertical direction V. Conversely, rotation of insert 220 relative to bracket 210 in a second, opposite direction can lower insert 220 and axle 62 along the vertical direction V. In such a manner, a position of one of doors 16 along the vertical direction V can be adjusted or changed.

As may be seen in FIG. 6, each hole of holes 232 extends between a first end portion 234 and a second end portion 236, e.g., along the lateral direction L. Each fastener of fasteners 230 is positioned or disposed within a respective hole of holes 232 such that each fastener of fasteners 230 is movable between the first and second end portions 234 and 236 of holes 232.

Utilizing fasteners 230, a position of bracket 210 and insert 220, e.g., along the lateral direction L, can be adjusted or changed. For example, a user can select the position of bracket 210 and insert 220, e.g., along the lateral direction L, and tighten fasteners 230 against bracket 210 in order to lock or set the position of bracket 210 and insert 220 on cabinet 12. Because axle 62 is disposed in inner chamber 222 of insert 220, a position of one of doors 16 along the lateral direction L can be adjusted or changed by moving bracket 210 and insert 220 on cabinet 12 and utilizing fasteners 230.

FIG. 7 provides a perspective, section view of a hinge assembly 300 for a door according to an additional exemplary embodiment of the present subject matter. FIG. 8 provides a bottom partial, perspective view hinge assembly 300. Hinge assembly 300 can be used with any suitable door, e.g., to mount the door to a cabinet. As an example, hinge assembly 300 may be used in oven appliance 10 (FIG. 1) to mount one of doors 16 to cabinet 12. In particular, hinge assembly 300 may be used as lower hinge 70 in oven appliance 100.

Hinge assembly 300 includes a bracket 310. Bracket 310 can be mounted to cabinet 12, e.g., at bottom portion 42 of cabinet 12. Bracket 310 can be mounted to cabinet 12 using any suitable method or mechanism. For example, fasteners may extend through holes 319 defined by bracket 310 into cabinet 12 in order to mount or fix bracket 310 to cabinet 12. As another example, bracket 310 may be welded, glued, snap-fit, etc. to cabinet 12.

Bracket 310 defines a slot 314. Slot 314 extends, e.g., along the lateral direction L, between a first end portion 316 and a second end portion 318. Thus, first and second end portions 316 and 318 of slot 314 are spaced apart from each other, e.g., along the lateral direction L.

Hinge assembly 300 also includes a mover 320 and an insert 330. Bracket 310 also defines a pocket 312, e.g., at a bottom portion 311 of bracket 310. Mover 320 is, e.g., movably or slidably, positioned or disposed within pocket 312 of bracket 310. Insert 330 is rotatably mounted or threaded to mover 320. For example, a thread of insert 330 can engage or mesh with a thread of mover 320 in order to rotatably mount insert 330 to mover 320. Insert 330 also defines an inner chamber 332. Axle 62 may be positioned or received within inner chamber 332 of insert 330. Axle 62 is rotatable within chamber 332, e.g., relative to insert 330 and/or bracket 310. In such a manner, axle 62 may be rotatably mounted to hinge assembly 300.

As discussed above, insert 330 is rotatable relative to mover 320. Rotation of insert 330 relative to mover 320 adjusts a height of axle 62, e.g., along the vertical direction V. For example, rotation of insert 330 relative to mover 320 in a first direction can raise insert 330 and axle 62 along the vertical direction V. Conversely, rotation of insert 330 relative to mover 320 in a second, opposite direction can lower insert 330 and axle 62 along the vertical direction V. In such a manner, a position of one of doors 16 along the vertical direction V can be adjusted or changed.

Insert 330 is received or disposed within slot 314. In particular, insert 330 can move or slide within slot 314, e.g., between first end portion 316 and second end portion 318 of slot 314. Movement of insert 330 can assist with positioning of door 16, e.g., along the lateral direction L, as discussed in greater detail below.

Hinge assembly 300 also includes a first set screw 340 and a second set screw 342. First and second set screws 340 and 342 are rotatably mounted (e.g., threaded) to bracket 310. First and second set screws 340 and 342 are positioned on opposite lateral sides of bracket 310 such that first and second set screws 340 and 342 are spaced apart from each other along the lateral direction L on bracket 310. In particular, first set screw 340 is positioned at or adjacent first end portion 316 of slot 314. Conversely, second set screw 342 is positioned at or adjacent second end portion 318 of slot 314. Mover 320 and insert 330 is positioned or disposed between first and second set screws 340 and 342 in slot 314. First and second set screws 340 and 342 engage mover 320 such that first and second set screws 340 and 342 hinder motion of mover 320 within pocket 312 and insert 330 within slot 314 along the lateral direction L. In particular, first and second screws 340 and 342 can be tightened against mover 320 such that mover 320 extends between first and second screws 340 and 342 along the lateral direction L.

Utilizing first and second set screws 340 and 342, a position of mover 320 in pocket 312 and insert 330 within slot 314 can be adjusted or changed. For example, as discussed above, insert 330 is moveable within slot 314 between first and second end portions 316 and 318 of slot 314. A user can select the position of insert 330 within slot 314 and tighten first and second set screws 340 and 342 against mover 320 in order to lock or set the position of mover 320 within pocket 312 and insert 330 in slot 314. Because axle 62 is disposed in inner chamber 332 of insert 330, a position of one of doors 16 along the lateral direction L can be adjusted or changed by moving mover 320 within pocket 312 and insert 330 within slot 314 and utilizing first and second set screws 340 and 342.

FIG. 9 provides a perspective, section view of a hinge assembly 400 for a door according to a further exemplary embodiment of the present subject matter. FIG. 10 provides a bottom partial, perspective view hinge assembly 400. Hinge assembly 400 can be used with any suitable door, e.g., to mount the door to a cabinet. As an example, hinge assembly 400 may be used in oven appliance 10 (FIG. 1) to mount one of doors 16 to cabinet 12. In particular, hinge assembly 400 may be used as lower hinge 70 in oven appliance 100. Hinge assembly 400 is similar to hinge assembly 400 and includes similar components and operates in similar manner.

As may be seen in FIGS. 9 and 10, hinge assembly 400 includes a fastener 440. Fastener 440 extends through a bracket 410 into a mover 420 of hinge assembly 400, e.g., at a bottom portion 411 of bracket 410. A head 442 of fastener 440 engages bracket 410 such that fastener 440 hinders motion of mover 420 within a pocket 412 of bracket 410 and also hinders motion of an insert 430 within a slot 414 of bracket 410, e.g., along the lateral direction L.

Utilizing fastener 440, a position of mover 420 in pocket 412 and insert 430 within slot 414 can be adjusted or changed. For example, insert 430 is moveable within slot 414, e.g., between a first end portion 414 and a second end portion 418 of slot 414, along the lateral direction L. A user can select the position of insert 430 within slot 414 and tighten fastener 440 against bracket 410 in order to lock or set the position of mover 420 within pocket 412 and insert 430 in slot 414. Because axle 62 is disposed in an inner chamber 432 of insert 430, a position of one of doors 16 along the lateral direction L can be adjusted or changed by moving mover 420 within pocket 412 and insert 430 within slot 414 and utilizing fastener 440.

FIG. 11 provides a perspective, section view of a hinge assembly 500 for a door according to yet another exemplary embodiment of the present subject matter. Hinge assembly 500 can be used with any suitable door, e.g., to mount the door to a cabinet. As an example, hinge assembly 500 may be used in oven appliance 10 (FIG. 1) to mount one of doors 16 to cabinet 12. In particular, hinge assembly 500 may be used as lower hinge 70 in oven appliance 100.

Hinge assembly 500 includes a bracket 510. Bracket 510 can be mounted to cabinet 12, e.g., at bottom portion 42 of cabinet 12. Bracket 510 can be mounted to cabinet 12 using any suitable method or mechanism. For example, fasteners may extend through holes 512 defined by bracket 510 into cabinet 12 in order to mount or fix bracket 510 to cabinet 12. As another example, bracket 510 may be welded, glued, snap-fit, etc. to cabinet 12.

Hinge assembly 500 also includes a pivot arm 520 and a pair of fasteners 540. Pivot arm 520 can be mounted cabinet 12 with fasteners 540. For example, fasteners 540 include a first fastener 542 and a second fastener 544. First fastener 542 extends through pivot arm 520 into cabinet 12. Second fastener 544 extends through pivot arm 520 to cabinet 12. Pivot arm 520 also defines an opening 522. Axle 62 may be positioned or received within opening 522 of pivot arm 520. Axle 62 is rotatable within opening 522, e.g., relative to pivot arm 520 and/or bracket 510. In such a manner, axle 62 may be rotatably mounted to hinge assembly 500.

Utilizing first and second fasteners 542 and 544, a position of opening 522 and axle 62 along the lateral direction L can be adjusted or changed. For example, rotation of first and second fasteners 542 and 544 in a first direction can move opening 522 and axle 62 in a first direction along the lateral direction V. Conversely, rotation of first and second fasteners 542 and 544 in a second, opposite direction can move opening 522 and axle 62 in a second, opposite direction along the lateral direction V. In such a manner, a position of one of doors 16 along the lateral direction L can be adjusted or changed.

Pivot arm 520 is positioned below bracket 510 along the vertical direction V. A bolt 530 extends between bracket 510 and pivot arm 520, e.g., along the vertical direction V. Bolt 530 is rotatably mounted or threaded to pivot arm 520. For example, a thread of bolt 530 can engage or mesh with a thread of pivot arm 520. Thus, bolt 530 couples bracket 510 and pivot arm 520 together, e.g., such that bracket 510 and bolt 530 hinder or prevent pivot arm 520 from moving downwardly along the vertical direction V.

Bolt 530 is rotatable relative to bracket 510 and pivot arm 520. Rotation of bolt 530 relative to bracket 510 and pivot arm 520 adjusts a height of axle 62, e.g., along the vertical direction V. For example, a user can loosen fasteners 540 to permit movement of pivot arm 520 along the vertical direction V. With fasteners 540 loosened, rotation of bolt 530 relative to bracket 510 and pivot arm 520 in a first direction can raise pivot arm 520 (e.g., opening 522 of pivot arm 520) and axle 62 along the vertical direction V. Conversely, rotation of bolt 530 relative to bracket 510 and pivot arm 520 in a second, opposite direction can lower pivot arm 520 (e.g., opening 522 of pivot arm 520) and axle 62 along the vertical direction V. With, pivot arm 520 suitably positioned, the user can reset fasteners 540 to lock and hinder movement of pivot arm 520. In such a manner, a position of one of doors 16 along the vertical direction V can be adjusted or changed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a vertical direction and a lateral direction, the vertical and lateral directions being perpendicular to each other, the oven appliance comprising:

a cabinet defining a cooking chamber;

a door having an axle;

a hinge assembly rotatably mounting the door to the cabinet, the hinge assembly comprising a bracket mounted to the cabinet, the bracket defining a slot that extends along the lateral direction between a first end portion and a second end portion;

an insert received within the slot such that the insert is movable between the first end portion of the slot and the second end portion of the slot, the insert defining an inner chamber, the axle of the door received within the inner chamber of the insert; and a first set screw rotatably mounted to the bracket at the first end portion of the slot and a second set screw rotatably mounted to the bracket at the second end portion of the slot, the first and second set screws engaging the insert such that the first and second set screws hinder motion of the insert within the slot along the lateral direction, a position of the axle along the lateral direction being adjustable when the first and second set screws are rotated relative to the bracket.

2. The oven appliance of claim 1, wherein the hinge assembly further comprises a height adjustment screw rotatably mounted to the insert, the height adjustment screw disposed below the axle of the door such that rotation of the height adjustment screw relative to the insert adjusts a height of the axle along the vertical direction.

3. The oven appliance of claim 1, wherein the hinge assembly further comprises a thrust bushing disposed within the inner chamber of the insert such that the thrust bushing is positioned between the axle of the door and the height adjustment screw along the vertical direction.

4. The oven appliance of claim 1, wherein the hinge assembly further comprises a radial bushing, the radial bushing disposed within the inner chamber of the insert such that the radial bushing is positioned between the axle of the door and an inner surface of the insert along the lateral direction.

5. The oven appliance of claim 1, wherein the insert comprises a flange positioned on a top surface of the bracket.

6. The oven appliance of claim 1, wherein the hinge assembly further comprises a plurality of fasteners extending through the bracket into the cabinet in order to mount the bracket to the cabinet.

7. The oven appliance of claim 6, wherein the bracket defines a plurality of slots, each slot of the plurality of slots of the bracket extending along between a first end portion and a second end portion along the lateral direction, each fastener of the plurality of fasteners extending through a respective slot of the plurality of slots of the bracket into the cabinet, each fastener of the plurality of fasteners positioned within the respective slot of the plurality of slots such that each fastener of the plurality of fasteners is movable between the first end portion of the respective slot of the plurality of slots and the second end portion of the respective slot of the plurality of slots.

8. An oven appliance defining a vertical direction and a lateral direction, the vertical and lateral directions being perpendicular to each other, the oven appliance comprising:

a cabinet defining a cooking chamber;

a door having an axle;

a hinge assembly rotatably mounting the door to the cabinet, the hinge assembly comprising a bracket mounted to the cabinet, the bracket defining a pocket and a slot, the slot extending along the lateral direction between a first end portion and a second end portion;

a mover disposed within the pocket of the bracket;

an insert rotatably mounted to the mover such that a thread of the insert engages a thread of the mover, the insert received within the slot such that the insert is movable between the first end portion of the slot and the second end portion of the slot, the insert defining an inner chamber, the axle of the door received within the inner chamber of the insert, a position of the axle along the vertical direction selectively adjustable by rotating the insert relative to the mover; and a fastener that extends through the bracket into the mover, a head of the fastener engaging the bracket such that the fastener hinders motion of the mover within the pocket along the lateral direction.

9. The oven appliance of claim 8, wherein the hinge assembly further comprises a first set screw rotatably mounted to the bracket at the first end portion of the slot and a second set screw rotatably mounted to the bracket at the second end portion of the slot, the first and second set screws engaging the mover such that the first and second set screws hinder motion of the mover within the pocket along the lateral direction, a position of the axle along the lateral direction being adjustable when the first and second set screws are rotated relative to the bracket.

10. The oven appliance of claim 8, wherein the hinge assembly further comprises a thrust bushing disposed within the inner chamber of the insert such that the thrust bushing is positioned between the axle of the door and a bottom surface of the insert along the vertical direction.

11. The oven appliance of claim 8, wherein the hinge assembly further comprises a radial bushing, the radial bushing disposed within the inner chamber of the insert such that the radial bushing is positioned between the axle of the door and an inner surface of the insert along the lateral direction.

12. An oven appliance defining a vertical direction and a lateral direction, the vertical and lateral directions being perpendicular to each other, the oven appliance comprising:

a cabinet defining a cooking chamber;

a door having an axle;

a hinge assembly rotatably mounting the door to the cabinet, the hinge assembly comprising a bracket mounted to the cabinet;

a pivot arm mounted to the cabinet and positioned below the bracket along the vertical direction, the pivot arm defining an opening, the axle of the door received within the opening of the pivot arm;

a bolt extending between the bracket and the pivot arm, a thread of the bolt engaging a thread of the pivot arm such that the bolt couples the bracket and the pivot arm to each other, a position of the axle along the vertical direction selectively adjustable by rotating the bolt relative to the bracket and the pivot arm; and a pair of fasteners, a first fastener of the pair of fasteners extending through the pivot arm into the cabinet, a second faster extending through the pivot arm to the cabinet, a position of the axle along the lateral direction selectively adjustable with the pair of fasteners.

13. An oven appliance defining a vertical direction and a lateral direction, the vertical and lateral directions being perpendicular to each other, the oven appliance comprising:

a cabinet defining a cooking chamber;

a door having an axle;

a hinge assembly rotatably mounting the door to the cabinet, the hinge assembly comprising a bracket mounted to the cabinet, wherein the bracket defines a plurality of slots, each slot of the plurality of slots of the bracket extending along between a first end portion and a second end portion along the lateral direction, each fastener of the plurality of fasteners extending through a respective slot of the plurality of slots of the bracket into the cabinet, each fastener of the plurality of fasteners positioned within the respective slot of the plurality of slots such that each fastener of the plurality of fasteners is movable between the first end portion of the respective slot of the plurality of slots and the second end portion of the respective slot of the plurality of slots;

an insert having a thread engaging a thread of the bracket such that the insert is rotatably mounted to the bracket, the insert defining an inner chamber, the axle of the door received within the inner chamber of the insert, a position of the axle along the vertical direction selectively adjustable by rotating the insert relative to the bracket; and a plurality of fasteners extending through the bracket into the cabinet in order to mount the bracket to the cabinet.

14. The oven appliance of claim 13, wherein the bracket defines a plurality of slots, each slot of the plurality of slots of the bracket extending along between a first end portion and a second end portion along the lateral direction, each fastener of the plurality of fasteners extending through a respective slot of the plurality of slots of the bracket into the cabinet, each fastener of the plurality of fasteners positioned within the respective slot of the plurality of slots such that each fastener of the plurality of fasteners is movable between the first end portion of the respective slot of the plurality of slots and the second end portion of the respective slot of the plurality of slots.

15. The oven appliance of claim 13, wherein the hinge assembly further comprises a thrust bushing disposed within the inner chamber of the insert such that the thrust bushing is positioned between the axle of the door and a bottom surface of the insert along the vertical direction.

16. The oven appliance of claim 13, wherein the hinge assembly further comprises a radial bushing, the radial bushing disposed within the inner chamber of the insert such that the radial bushing is positioned between the axle of the door and an inner surface of the insert along the lateral direction.

* * * * *